US007441607B2

(12) United States Patent
Telfer

(10) Patent No.: US 7,441,607 B2
(45) Date of Patent: Oct. 28, 2008

(54) CIRCULATION TOOL

(75) Inventor: George Telfer, Aberdeen (GB)

(73) Assignee: Specialised Petroleum Group Services Limited, Aberdeen (GB)

( * ) Notice: Subject to any disclaimer, the term of this patent is extended or adjusted under 35 U.S.C. 154(b) by 105 days.

(21) Appl. No.: 10/561,928

(22) PCT Filed: Jun. 30, 2004

(86) PCT No.: PCT/GB2004/002806

§ 371 (c)(1),
(2), (4) Date: May 25, 2006

(87) PCT Pub. No.: WO2005/003508

PCT Pub. Date: Jan. 13, 2005

(65) Prior Publication Data

US 2007/0125553 A1 Jun. 7, 2007

(30) Foreign Application Priority Data

Jul. 1, 2003 (GB) ..... 0315340.0

(51) Int. Cl.
*E21B 33/00* (2006.01)

(52) U.S. Cl. ..... 166/386; 166/321; 175/231

(58) Field of Classification Search ..... None
See application file for complete search history.

(56) References Cited

U.S. PATENT DOCUMENTS

| | | | | |
|---|---|---|---|---|
| 5,890,540 | A | 4/1999 | Pia et al. | |
| 6,152,228 | A | 11/2000 | Carmichael | |
| 6,173,795 | B1 | 1/2001 | McGarian et al. | |
| 6,520,257 | B2 * | 2/2003 | Allamon et al. | 166/291 |
| 2003/0024706 | A1 | 2/2003 | Allamon | |

FOREIGN PATENT DOCUMENTS

| | | |
|---|---|---|
| EP | 0251543 | 1/1988 |
| GB | 2 272 923 A | 6/1994 |

* cited by examiner

*Primary Examiner*—Frank S Tsay
(74) *Attorney, Agent, or Firm*—Osha Liang, LLP

(57) ABSTRACT

A downhole tool for circulating fluid in a well bore. The tool includes an axial inlet and outlet with radial second outlets. A sleeve moves over the second outlets to control circulation of fluid. The sleeve can be selectively locked in an opened or closed configuration while the tool is in tension or compression. Variation of fluid pressure in the work string and stroking the tool move the sleeve between the operating positions. Cyclic operation of the tool is also described.

25 Claims, 2 Drawing Sheets

CIRCULATION TOOL

CROSS REFERENCE TO RELATED APPLICATIONS

This application claims priority from PCT/GB2004/002806, having an international filing date of 30 Jun. 2004, and a priority date of 1 Jul. 2003.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The present invention relates to a downhole tool for circulating fluid in a well bore and in particular, though not exclusively, to a circulation tool which can be selectively locked in an opened or closed configuration while in tension or compression.

At various times during the drilling, completion and production of an oil or gas well, it may be necessary to circulate fluid within the well bore. This is typically done by running a tool on a workstring, the tool having a cylindrical body with radial ports, through which fluid from the bore of the workstring can pass. The procedure can provide a cleaning action and/or provide a transport system to carry debris and other materials from the well bore to the surface in the circulating fluid.

A known circulating tool is that disclosed in GB 2272923. This tool for circulating fluid in a well bore comprises a body member having a radial fluid outlet. An isolation sleeve is movably mounted on the body member for movement between an open position in which fluid may flow out of the outlet and a closed position. The isolation sleeve is moved to its open position against the action of spring by engaging a shoulder with the top of a liner and setting down on the tubing string. Alternatively, the outlet is opened when the lower end of the tubing string engages the bottom of the well bore.

This tool has a number of disadvantages. The tool can operate only by contacting a formation in the well bore e.g. a liner top or bottom of the well, and thus cannot be operated at any desired location in the well bore. In contacting a formation the tool is held in compression which limits other functions which can be performed from the work string when fluid is circulated through the tool. Further any spurious debris in the well bore, or indeed sudden pressure changes within the well bore can cause the tool to operate prematurely.

U.S. Pat. No. 6,152,228 provides a circulation tool which overcomes the problem of premature operation. The tool comprises a tubular assembly which has an axial through passage between a fluid inlet and first fluid outlet. The fluid inlet and the first fluid outlet are connected in a work string which is supported from the surface above the well bore. There is a second outlet which extends generally transversely of the assembly. An obturating member is moveable between a first position in which the second fluid outlet is closed and a second position which permits fluid flow through the second outlet. An engagement mechanism is moveable between an engaged configuration in which the obturating member is maintained in one of the first and second positions, and a disengaged configuration in which the obturating member is in the other of the first and second positions. The tubular assembly is coupled to a shoulder which is engageable with the formation in the well bore to engage or disengage the engagement mechanism. Setting down weight on the work string causes a formation of the well bore to exert a force on the shoulder which results in the second outlet being opened.

As the engagement mechanism allow the tool to be maintained in either the open or closed configuration, the tool cannot be prematurely set. However, the major disadvantage of this tool is that its use is limited to locations within the well bore where a formation exists so that the tool must be placed in compression to switch configuration.

It is an object of the present invention to provide a circulation tool which can be selectively opened and closed without the need to set down weight on the tool or contact a formation in the well bore.

It is a further object of at least one embodiment of the present invention to provide a circulation tool which can be locked in an open or closed configuration to operate the tool in tension or compression.

It is a still further object of at least one embodiment of the present invention to provide a method of operating a circulation tool by varying fluid pressure through the tool from pumps located above the tool.

SUMMARY OF THE INVENTION

According to a first aspect of the present invention there is provided a tool for circulating fluid in a well bore, the tool comprising a tubular assembly having a through passage between an inlet and a first outlet, the inlet and first outlet being adapted for connection in a work string, a second outlet extending generally transversely of the tubular assembly of the tubular assembly;

an obturating member moveable between a first position closing the second outlet and a second position permitting fluid flow through the second outlet, the obturating member including restraining means to actively retain the obturating member independently in the first and the second positions;

an engagement mechanism actuable between an engaged configuration, in which the obturating member is locked in one of the first or second positions; and a disengaged configuration in which the obturating member can move to the other of the first and second positions;

a fluid pressure actuation surface coupled to the engagement mechanism and biased by a spring located between the tubular assembly and the engagement mechanism;

wherein variation of fluid pressure on the actuation surface controls actuation of the engagement mechanism and stroking the tool in the disengaged configuration moves the obturating member.

Preferably the obturating member comprises a sleeve axially slidable within the tubular assembly. Preferably the restraining means is a collet. The collet may be retainable in a plurality of recesses on the tubular assembly.

Preferably the fluid pressure actuation surface is located on an actuator sleeve axially slidable within the tubular assembly. More preferably a portion of the actuator sleeve can locate across the collet.

Preferably the engagement mechanism comprises mutually engageable formations on each of the actuator sleeve and the tubular assembly. More preferably the formations comprise a pin and a groove. Advantageously the groove is continuous so that the pin can travel in a continuous cycle around the groove. Preferably the groove comprises a plurality of apexes and bases such that the pin moves longitudinally to the tubular assembly. The distance of longitudinal travel will determine whether the engagement mechanism is in the locked or disengaged position.

Preferably also the second outlet comprises a plurality of ports in the tubular assembly which communicate with the inlet. Typically the ports may be distributed circumferentially around the outer surface of the tubular assembly.

Typically the cross-sectional area of the first outlet is greater than the cross-sectional area of the second outlet.

The ports may be designed to direct the fluid exiting the second outlet in an uphole or downhole direction into the well bore.

According to a second aspect of the present invention there is provided a method for circulating fluid in a well bore, the method comprises the steps:

(a) inserting a work string into the well bore, the work string having a fluid inlet, a first fluid outlet and a second fluid outlet, an obturating member which is moveable between a first and second position to respectively close and open the second fluid outlet, and an engagement mechanism which when engaged locks the obturating member in one of the first or second positions;

(a) varying the fluid pressure through the work string to move the engagement mechanism between locked and unlocked configurations; and (b) stroking the work string to move the obturating member between the first and second positions.

Preferably varying the fluid pressure through the work string is achieved by pumping fluid through the work string.

Preferably the method includes the step of running the work string in a closed and locked configuration with the pumps turned off.

Preferably the method includes the step of drilling with the work string in a closed and locked configuration and in compression while pumping fluid.

Preferably the method includes the step of back reaming with the work string in a closed and unlocked configuration and in tension while pumping fluid.

Preferably also the method includes the step of opening the second outlet with the work string in tension with the pumps off.

Preferably also the method includes the step of stroking the work string in a locked and open configuration while pumping fluid.

Preferably also the method includes the step of stroking the work string in a locked and open configuration with the pumps off.

Preferably the method includes operating the work string in a cyclic manner through the following configurations:

(a) locked closed;
(b) unlocked closed;
(c) unlocked open;
(d) locked open;
(e) unlocked open; and
(f) unlocked closed.

BRIEF DESCRIPTION OF THE DRAWINGS

An embodiment of the present invention will now be described, by way of example only, with reference to the following drawings of which.

DETAILED DESCRIPTION OF THE PREFERRED EMBODIMENTS

Figure 1:
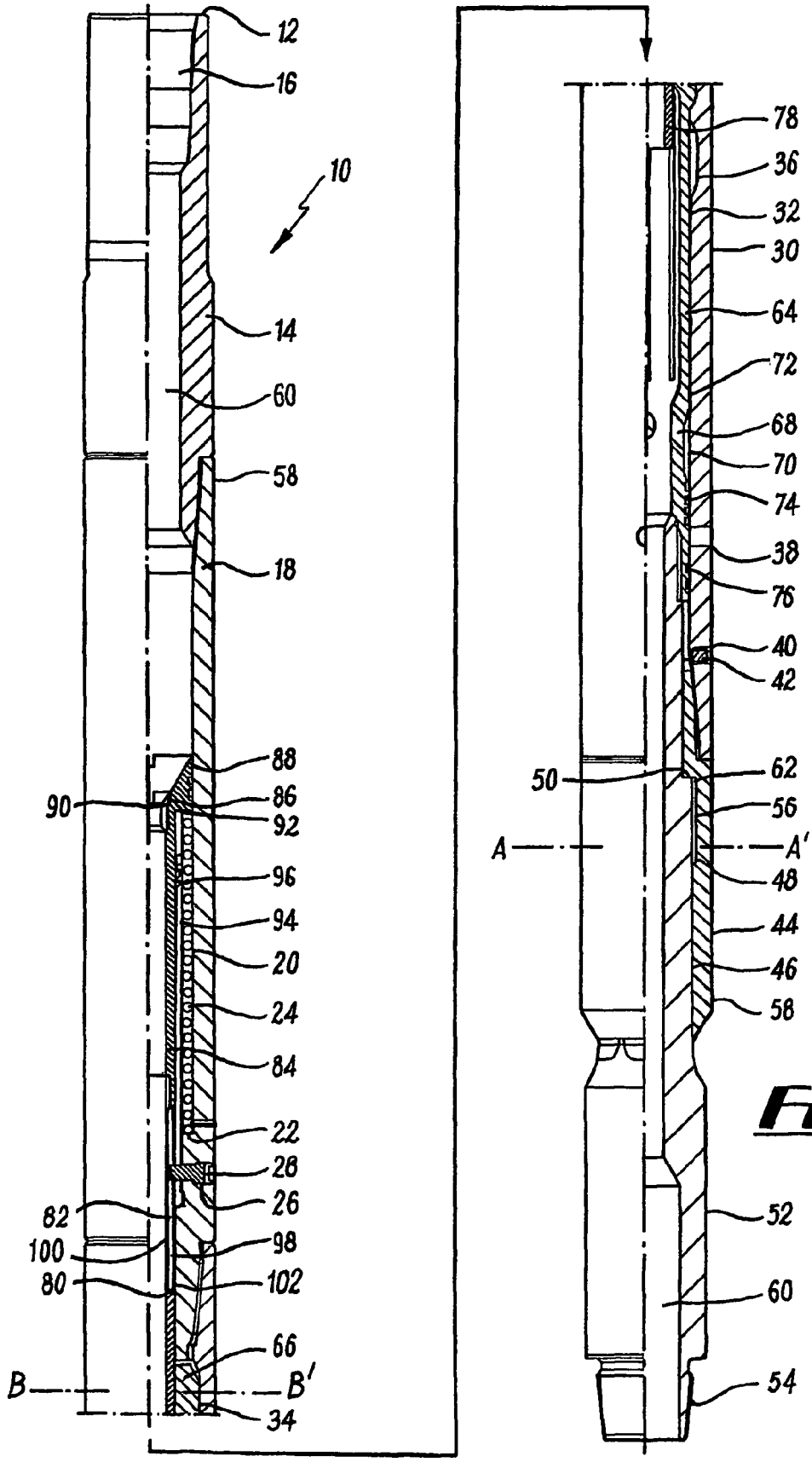
FIG. 1 is a part cross-sectional view of a tool for circulating fluid in a well bore according to an embodiment of the present invention.

Reference is initially made to FIG. 1 of the drawings which illustrates a tool, generally indicated by reference numeral 10, for circulating fluid in a well bore. Tool 10 has an upper end 12 comprising a top sub 14 being a cylindrical body and including a box section 16 for connecting the tool 10 to a work string or drill string. Located below the top sub 14 and connected thereto is a spring housing 18. Spring housing 18 is a substantially cylindrical body whose inner surface 20 includes a shoulder 22 against which a spring 24 is located. A radial port 26 is arranged through the spring housing 18 through which an index pin 28 is located. Though only a single index pin 28 is shown, more than one index pin may be used. In the preferred embodiment two index pins 28 are arranged opposite each other.

Located below the spring housing 18 and connected thereto is a collet housing 30. Collet housing 30 comprises a tubular body with an inner surface 32. Arranged on inner surface 32 are two concentric recesses 34,36. Arranged through the body are radial ports 38. In the preferred embodiment there are four radial ports arranged equidistantly around the housing body. A further access port 40 is provided in the housing 30 through which a plug and grease nipple arrangement 42 is positioned.

Figure 3:
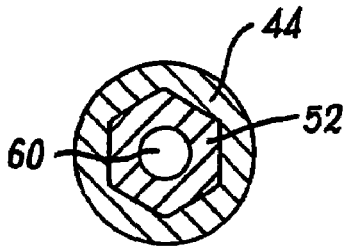
FIG. 3 is a view through the section line A-A' of FIG. 1.

Located below the collet housing and connected thereto is a hex drive 44. Hex drive 44 comprises a cylindrical body having an inner surface 46 of which a portion 48 is hexagonal. At an upper end of the portion 48 is located a ledge 50. The hex drive 44 is positioned over a bottom sub 52 which extends therefrom. Bottom sub 52 includes a pin section 54 at a lower end for connection into a work string or drill string. A shoulder 62 is located to engage the ledge 50. The sub 52 also includes a hexagonal mating portion 56 to match the portion 48 on the hex drive 44. This is shown with the aid of FIG. 3 which demonstrates the hex profile matching between the hex drive 44 and the bottom sub 52. In this way rotation of the hex drive 44 will be transmitted to the bottom sub 52.

The top sub 14, spring housing 18, collet housing 30, hex drive 44 and bottom sub 52 provide an outer surface 58 to the tool 10 while principally defining a central bore 60 through the tool for fluid communication with the work string. Rotation of the work string will be transmitted through the entire assembly regardless of whether fluid is being circulated out of the tool.

Figure 4:
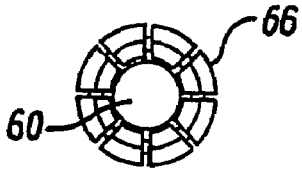
FIG. 4 is a part view through the section line B-B' of FIG. 1.

Arranged within the central bore 60 against the collet housing 30 is a collet assembly 64. Assembly 64 is substantially cylindrical to allow the passage of fluid through the central bore 60. The assembly includes, at its upper end eight sprung pins 66 which are biased in an outwardly radial direction. These pins 66 are shown in cross-section in FIG. 4, illustrating the bulbous heads which are sized to fit within recess 34 or recess 36 on the collet housing 30. Assembly 64 includes radial ports 68 arranged equidistantly around and through the assembly 64. Preferably there are four ports 68 to match the four ports 38 on the collet housing 30. The collet assembly 64 is located against the housing 30 to provide a channel 70 around the ports 68. The channel is sealed via a wear ring 72 and o-rings 74 located at each end of the channel 70. The channel 70 allows the ports 68, 38 to be near alignment for fluid to flow from the central bore 60 to the outer surface 58 of the tool 10. A further set of o-rings 76 are located between a lower end of the assembly 64 and the housing 30 such that, when the ports 68, 38 are sufficiently misaligned and the passage for fluid is blocked, the ports 38 on the housing 30 are sealed to prevent the ingress of fluid between the housing 30 and the assembly 64.

Also located within the bore 60 is a collet support sleeve 78. Sleeve 78 is sized to locate over the sprung pins 66 of the collet assembly 64 and hold them in place within recess 34 or recess 36 as desired. The sleeve 78 can also locate above the collet assembly 64 leaving the pins 66 free to move within the central bore 60 against the inner surface 32 of the collet housing 30. An upper end 80 of sleeve 78 is connected to an actuator sleeve 82. The connection includes a bearing ring. Thus sleeve 78 is moved by virtue of actuation of the actuator sleeve 82. Actuator sleeve 82 has an inner surface 84 located against the central bore 60. At an upper end 86 of the sleeve 82 is a conical surface 88. Surface 88 is a fluid pressure actuated surface. At the base of the surface 88 is located a choke ring 90. Surface 88 and choke ring 90 together ensure that variations in fluid pressure through the central bore 60 can cause movement of the actuator sleeve 82. At the upper end 86 facing the inner surface 20 of the spring housing 18 is a shoulder 92. Shoulder 92 is oppositely opposed to shoulder 22 of the spring housing 18. Between the shoulders 22,92 is arranged the spring 24. The shoulder 22 is fixed and thus movement of the actuator sleeve 82 downward is against the bias of the spring 24.

Adjacent the spring 24, between the actuator sleeve 84 and the spring housing 18 is located a cylinder sleeve 94. O-rings 96 seal the cylinder sleeve 94 against the actuator sleeve 84 but they do not prevent relative movement occurring between the sleeves. Cylinder sleeve 94 is held in position by virtue of the index pin 28 located through the access port 26 on the spring housing 18. Pin 28 locates through the cylinder sleeve 94 and into an index sleeve 98. Index sleeve 98 is located in a recess 100 of the actuator sleeve 84 with bearing rings located at each end thereof. Thus movement of the actuator sleeve 84 can move the index sleeve 98 and likewise arrest of the index sleeve 98 can prevent movement of the actuator sleeve 84. Additionally the index sleeve 98 can rotate without the rotating the actuator sleeve 84.

Figure 2:
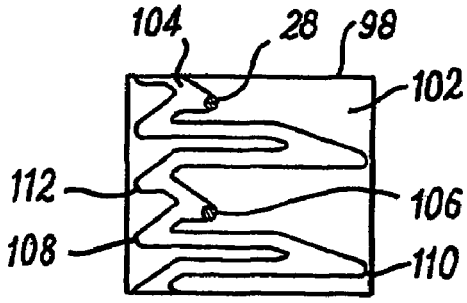
FIG. 2 is a schematic view of the profile of the groove in the index sleeve of the tool of FIG. 1.

On an inner surface 102 of the index sleeve 98 is located a groove or profile 104. This is best seen with the aid of FIG. 2 which shows the developed circumference of the index sleeve 98. In the Figure shown there are two index pins 28 making an identical path through the profile 104. The index pins 28 are shown located in a small apex 106. Actuation on the sleeve 98 will cause the pins to move to a first base 108. The bias on spring 24 will move the pins 28 to a high apex 110 providing the greatest longitudinal movement of the sleeve 98. On return the pins will locate in a second base 112. As will be appreciated the pins 28 can cycle continuously around the sleeve 98 and consequently the movement of the actuator sleeve 84 can be controlled. When the pins 28 are located in the small apex the actuator sleeve 84 is effectively locked in position. A longitudinal wall on the first base side prevents accidental movement into the high apex 110, and movement in the opposite direction causes the pin 28 to fall into the second base 112.

In use, the tool is inserted into a drill string and connected thereto by use of the box section 16 and the pin section 54. We will describe the operation of the tool cycling from a closed and locked position to an identical position. It will be understood that the tool can be cycled from any starting position in the cycle and thus the tool run into a well bore in any configuration and pulled from the well bore in any configuration.

Additionally it will be appreciated that although the description has referred to terms such as upper, lower, above, below, these are all relative. The tool of the present invention finds equal application in non-vertical wells such as those that are inclined or horizontal.

The tool 10 is run on the drill string into the well bore in a locked closed configuration. In this configuration the index pins 28 are located in the small apex 106 of the profile 104 on the index sleeve 98. This 'locks' the index sleeve 98 in position and with it the actuator sleeve 84 and the collet support sleeve 78. Collet support sleeve 78 extends over the sprung pins 66 of the collet assembly 64 and thus holds the sprung pins 66 in the upper recess 34. Radial ports 68 and 38 are thus misaligned and the tool is 'closed'. Fluid low is only through the central bore 60.

In order for drilling to take place from the end of the drill string, fluid is required to be pumped through the central bore. The drilling action compresses the drill string and thus the tool 10 is in compression. Fluid pressure on the pressure surface 88 causes movement of the actuator sleeve and with it the index sleeve 98. Index pin 28 moves to the first base 108 and the compression prevents it from moving into the high apex 112. Loading within the tool is on the shoulder 62. This effectively is a downstroke. The tool remains locked and closed. On the upstroke, occurring when drilling stops and back reaming for instance starts, the drag forces created by the weight of tools on the string below tool 10 causes tool 10 to go into tension. The index pin 28 remains in the first base 108 and the tool is still in the locked and closed position. Loading, however, has shifted from shoulder 62 to the sprung pins 66 against the recess 34.

Turning the pumps off to lower fluid pressure in the tool 10 and again stroking the tool, causes the collet support sleeve 78 to raise and clear the sprung pins 66 on the downstroke and move the sprung pins 66 to the lower recess 36 on the upstroke. The index pin 28 is now located in the high apex 110. Movement of the sprung pins 66 to the lower recess 36 causes lowering of the collet assembly 64 within the tool 10. Channel 70 now locates across the radial ports 38 and fluid can thus circulate from the bore 60 through the ports 68 and out of the tool 10 to the outer surface 58 via ports 38. The tool 10 is 'open'.

To 'lock' the tool 'open' the pumps are turned on and pumping is maintained at a sufficiently high rate to cause movement of the actuator sleeve 84 against the spring 24 by fluid pressure on the pressure surface 88. The collet support sleeve 78 moves across the sprung pins 66 to hold them in the lower recess 36. Index pin 28 is moved to the second base 112. The ports will remain open in this configuration even if the tool 10 is moved up and down in a well bore or back and forth in an inclined well bore. Stroking the tool merely switches loading between the sprung pins 66 on the recess 36 and the top of the hex drive 44.

When the pumps are turned off in this configuration the tool 10 will remain 'open' and 'locked' as the only movement occurring is the index pin 28 moving into the small apex 106.

To reset, the tool 10 is placed in tension and picked-up on the upstroke. This releases the collet support sleeve 78 from the sprung pins 66 and allows them to move back to recess 34. Switching on and off of the pumps with a downstroke will return the tool 10 to the 'locked' and 'closed' configuration. The cycle can be resumed from this point whenever fluid circulation from the tool 10 is required. Alternatively the tool can be pulled out of the well bore on the string.

The principal advantage of the present invention is that it provides a tool for circulating fluid in a well bore which can be operated without the need to land the tool on a formation. This allows the tool to be operated in inclined or horizontal well bores. This provides the further advantage that the tool can be operated on a drill string so that circulation can be used to sweep cuttings from the bit back to the surface of the well. Jetting fluid from the tool can also held clear blockages in the well bore.

A further advantage of the present invention is that it provides a tool which can be locked in the open or closed position whether the tool is placed in tension or compression. Additionally the hex drive allows other tools to be operated below the tool regardless of the configuration of the tool.

Further modifications may be made to the invention hereindescribed without departing from the scope thereof. For example, The actuator sleeve and the index sleeve could be a unitary piece. The collet assembly could comprise two sleeves, the first including the sprung pins and the second including the radial ports, with the first sleeve acting on the second to open the ports.

The invention claimed is:

1. A tool for circulating fluid in a well bore, the tool comprising:

a tubular assembly having a through passage between an inlet and a first outlet, the inlet and first outlet being adapted for connection in a work string, a second outlet extending generally transversely of the tubular assembly;

an obturating member moveable between a first position closing the second outlet and a second position permitting fluid flow through the second outlet, the obturating member including restraining means to actively retain the obturating member independently in the first and the second positions; an engagement mechanism actuable between an engaged configuration, in which the obturating member is locked in one of the first or second positions, and a disengaged configuration in which the obturating member can move to the other of the first and second positions; and a fluid pressure actuation surface coupled to the engagement mechanism and biased by a spring located between the tubular assembly and the engagement mechanism;

wherein variation of fluid pressure on the actuation surface controls actuation of the engagement mechanism between the engaged and disengaged configurations;

and wherein, with the engagement mechanism in the disengaged configuration and the obturating member in the first position, an upstroke of the tool, putting the tool in tension, moves the obturating member to the second position, thereby permitting fluid flow to the second outlet;

and further wherein, with the engagement mechanism in the disengaged configuration and the obturating member in the second position, a downstroke of the tool, putting the tool in compression, moves the obturating member to the first position, thereby closing the second outlet.

2. A tool as claimed in claim 1, wherein the obturating member comprises a sleeve axially slidable within the tubular assembly.

3. A tool as claimed in claim 1, wherein the restraining means is a collet.

4. A tool as claimed in claim 3, wherein the collet is retainable in a plurality of recesses on the tubular assembly.

5. A tool as claimed in claim 1, wherein the fluid pressure actuation surface is located on an actuator sleeve axially slidable within the tubular assembly.

6. A tool as claimed in claim 5, wherein the restraining means is a collet and further wherein a portion of the actuator sleeve is located across the collet.

7. A tool as claimed in claim 5, wherein the engagement mechanism comprises mutually engageable formations on each of the actuator sleeve and the tubular assembly.

8. A tool as claimed in claim 7, wherein the formations comprise a pin and a groove.

9. A tool as claimed in claim 8, wherein the groove is continuous so that the pin can travel in a continuous cycle around the groove.

10. A tool as claimed in claim 9, wherein the groove comprises a plurality of apexes and bases such that the pin moves longitudinally relative to the tubular assembly, for at least a portion of the cycle.

11. A tool as claimed in claim 1, wherein the second outlet comprises a plurality of ports in the tubular assembly which communicate with the inlet.

12. A tool as claimed in claim 11 wherein the ports are distributed circumferentially around the outer surface of the tubular assembly.

13. A tool as claimed in claim 1, wherein the cross-sectional area of the first outlet is greater than the cross-sectional area of the second outlet.

14. A method for circulating fluid in a well bore, the method comprising the steps:

(a) inserting a work string into the well bore, the work string having a fluid inlet, a first fluid outlet and a second fluid outlet, an obturating member which is moveable between a first and second position to respectively close and open the second fluid outlet, and an engagement mechanism which when engaged locks the obturating member in one of the first or second positions;

(b) varying the fluid pressure through the work string to move the engagement mechanism between locked and unlocked configurations;

(c) with the engagement mechanism in the unlocked configuration and the obturating member in the first position, selectively stroking the work string up to place the work string in tension, to move the obturating member to the second position and thereby open the second fluid outlet; and (d) with the engagement mechanism in the unlocked configuration and the obturating member in the second position, selectively stroking the work string down to place the string in compression, to move the obturating member to the first position and thereby close the second fluid outlet.

15. A method as claimed in claim 14, wherein varying the fluid pressure through the work string is achieved by pumping fluid through the work string.

16. A method as claimed in claim 15, wherein the method includes the step of running the work string in a closed and locked configuration with the pumps used to pump fluid through the work string turned off.

17. A method as claimed in claim 15, wherein the method includes the step of drilling with the work string in a closed and locked configuration and in compression while pumping fluid.

18. A method as claimed in claim 15, wherein the method includes the step of back reaming with the work string in a closed and unlocked configuration and in tension while pumping fluid.

19. A method as claimed in claim 15, wherein the method includes the step of opening the second outlet with the work string in tension with the pumps used to pump fluid through the work string off.

20. A method as claimed in claim 15, wherein the method includes the step of stroking the work string in a locked and open configuration while pumping fluid.

21. A method as claimed in claim 15, wherein the method includes the step of stroking the work string in a locked and open configuration with the pumps used to pump fluid through the work string off.

22. A method as claimed in claim 14, wherein the method includes operating the work string in a cyclic manner through the following configurations:

(a) locked closed;
(b) unlocked closed;
(c) unlocked open;
(d) locked open;
(e) unlocked open; and
(f) unlocked closed.

23. A method for circulating fluid in a well bore, the method comprising the steps:

(a) inserting a work string into the well bore, the work string having a fluid inlet, a first fluid outlet and a second fluid outlet, an obturating member which is moveable between a first and second position to respectively close and open the second fluid outlet, and an engagement mechanism which when engaged locks the obturating member in one of the first or second positions;
(b) varying the fluid pressure through the work string by pumping fluid through the work string, to move the engagement mechanism between locked and unlocked configurations;
(c) stroking the work string to move the obturating member between the first and second positions; and
(d) back reaming with the work string in a dosed and unlocked configuration and in tension while pumping fluid.

24. A method for circulating fluid in a well bore, the method comprising the steps:

(a) inserting a work string into the well bore, the work string having a fluid inlet, a first fluid outlet and a second fluid outlet, an obturating member which is moveable between a first and second position to respectively close and open the second fluid outlet, and an engagement mechanism which when engaged locks the obturating member in one of the first or second positions;
(b) varying the fluid pressure through the work string by pumping fluid through the work string, to move the engagement mechanism between locked and unlocked configurations;
(c) stroking the work string to move the obturating member between the first and second positions; and
(d) opening the second outlet with the work string in tension and with the pumps used to pump fluid through the work string off.

25. A method for circulating fluid in a well bore, the method comprising the steps:

(a) inserting a work string into the well bore, the work string having a fluid inlet, a first fluid outlet and a second fluid outlet, an obturating member which is moveable between a first and second position to respectively close and open the second fluid outlet, and an engagement mechanism which when engaged locks the obturating member in one of the first or second positions;
(b) varying the fluid pressure through the work string by pumping fluid through the work string, to move the engagement mechanism between locked and unlocked configurations; and
(c) stroking the work string to move the obturating member between the first and second positions;

wherein the step of stroking the work string includes stroking the string in a locked and open configuration and with the pumps used to pump fluid through the work string off.

* * * * *